US007957542B2

(12) United States Patent
Sarrukh et al.

(10) Patent No.: US 7,957,542 B2
(45) Date of Patent: Jun. 7, 2011

(54) ADAPTIVE BEAMFORMER, SIDELOBE CANCELLER, HANDSFREE SPEECH COMMUNICATION DEVICE

(75) Inventors: Bahaa Eddine Sarrukh, Eindhoven (NL); Cornelis Pieter Janse, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1257 days.

(21) Appl. No.: 11/568,240

(22) PCT Filed: Apr. 20, 2005

(86) PCT No.: PCT/IB2005/051291
§ 371 (c)(1),
(2), (4) Date: Oct. 24, 2006

(87) PCT Pub. No.: WO2005/106841

PCT Pub. Date: Nov. 10, 2005

(65) Prior Publication Data

US 2007/0273585 A1 Nov. 29, 2007

(30) Foreign Application Priority Data

Apr. 28, 2004 (EP) ..... 04101796

(51) Int. Cl.
*H04R 3/00* (2006.01)

(52) U.S. Cl. ..... 381/92; 381/94.1; 381/94.2; 381/94.7; 381/66; 367/118; 367/119; 704/226

(58) Field of Classification Search ..... 381/91–92, 381/66, 94.1–94.2, 94.7, 122; 367/118–119; 704/226

See application file for complete search history.

(56) References Cited

U.S. PATENT DOCUMENTS

| | | | | |
|---|---|---|---|---|
| 6,192,134 | B1 * | 2/2001 | White et al. | 381/92 |
| 7,054,437 | B2 * | 5/2006 | Enzner | 379/406.08 |
| 7,443,989 | B2 * | 10/2008 | Choi et al. | 381/92 |
| 7,613,310 | B2 * | 11/2009 | Mao | 381/94.7 |

FOREIGN PATENT DOCUMENTS

| | | | |
|---|---|---|---|
| EP | 1286175 | A2 | 2/2003 |
| WO | WO0028740 | A2 | 5/2000 |
| WO | WO2005050618 | A2 | 6/2005 |

* cited by examiner

OTHER PUBLICATIONS

Fancourt et al: "The Generalized Sidelobe Decorrelator"; Proceedings of the IEEE Workshop on Applications of Signal Processing to Audio and Acoustics 2001.

*Primary Examiner* — Devona E Faulk
*Assistant Examiner* — Disler Paul
(74) *Attorney, Agent, or Firm* — Edward W. Goodman

(57) ABSTRACT

The adaptive beamformer unit (191) comprises: a filtered sum beamformer (107) arranged to process input audio signals (u1, u2) from an array of respective microphones (101, 103), and arranged to yield as an output a first audio signal (z) predominantly corresponding to sound from a desired audio source (160) by filtering with a first adaptive filter (f1(-t)) a first one of the input audio signals (u1) and with a second adaptive filter (f2(-t)) a second one of the input audio signals (u2), the coefficients of the first filter (f1(-t)) and the second filter (f2(-t)) being adaptable with a first step size (a1) and a second step size ((x2) respectively; noise measure derivation means (111) arranged to derive from the input audio signals (u1, u2) a first noise measure (x1) and a second noise measure (x2); and an updating unit (192) arranged to determine the first and second step size (a1, (x2) with an equation comprising in a denominator the first noise measure (x1) for the first step size (a1), respectively the second noise measure (x2) for the second step size (a2). This makes the beamformer relatively robust against the influence of correlated audio interference. The beamformer may also be incorporated in a sidelobe canceller topology yielding a more noise cleaned desired sound estimate, which can be used in a related, more advanced adaptive filter (f1(-t), f2(-t)) updating. Such a beamformer is typically useful for application in handsfree speech communication systems.

15 Claims, 3 Drawing Sheets

ADAPTIVE BEAMFORMER, SIDELOBE CANCELLER, HANDSFREE SPEECH COMMUNICATION DEVICE

Figure 1:
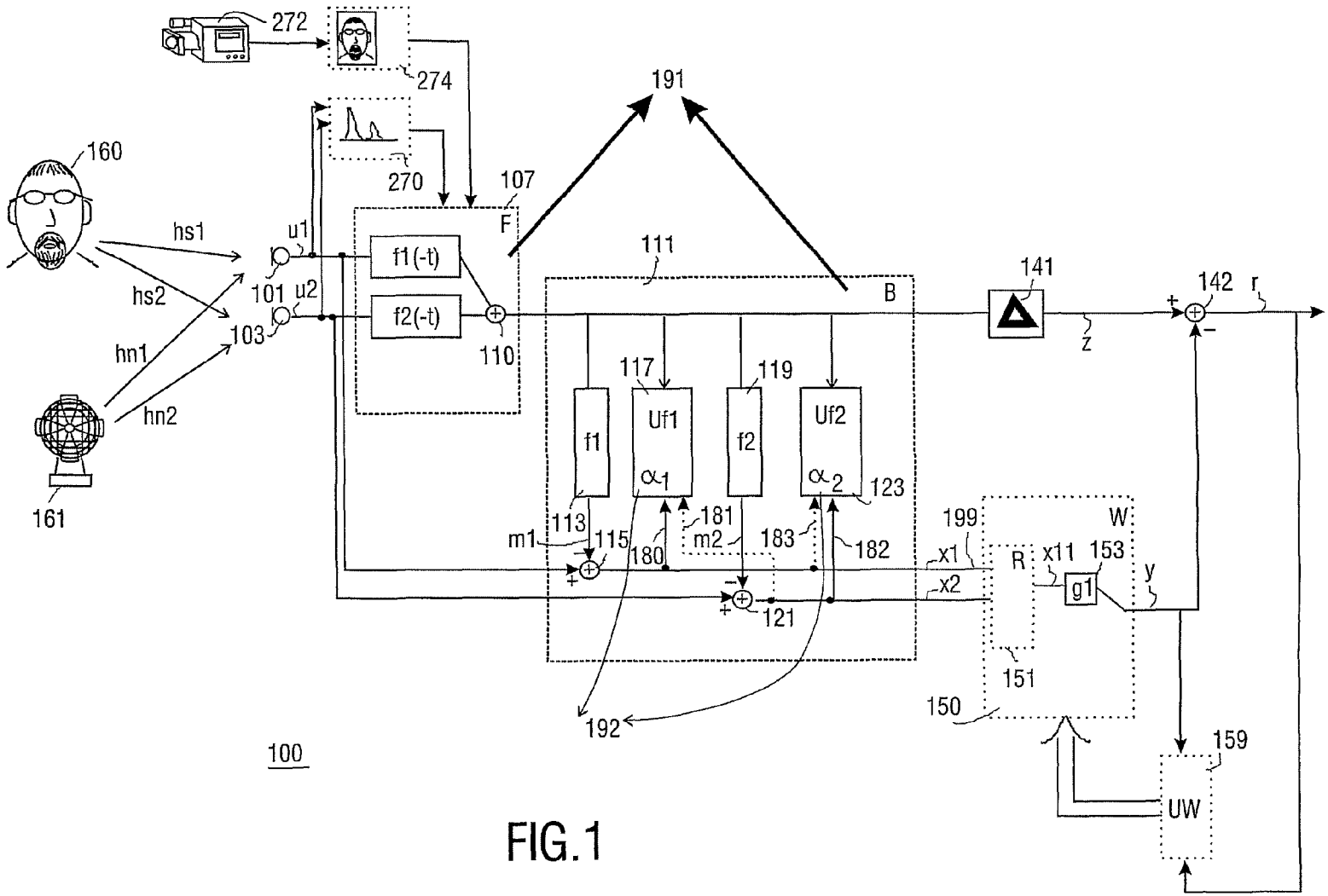

The invention relates to an adaptive beamformer unit and a sidelobe canceller comprising such an adaptive beamformer.

The invention also relates to a handsfree speech communication system, portable speech communication device, voice control unit and tracking device for tracking an audio producing object, comprising such an adaptive beamformer or sidelobe canceller.

The invention also relates to a consumer apparatus comprising such a voice control unit.

The invention also relates to a method of adaptive beamforming or sidelobe canceling and a computer program product comprising code of the method.

An embodiment of a sidelobe canceller and comprised beamformer as announced in the first paragraph is known from the publication "C. Fancourt and L. Parra: The generalized sidelobe decorrelator. Proceedings of the IEEE Workshop on applications of signal processing to audio and acoustics 2001." Beamformers and sidelobe cancellers are designed to lock in on a desired sound source, i.e. producing an output audio signal predominantly corresponding to the sound from the desired sound source, while avoiding as much as possible sound from other sources, called noise. A sidelobe canceller comprises an adaptive beamformer arranged to process signals from an array of microphones, of which beamformer filters can be optimized, so that these filters represent the inverse of the paths of the desired audio from the desired sound source to each of the microphones (i.e. the desired audio is modified by e.g. reflecting off various surfaces and finally entering a particular microphone from different directions). By summing the filtered signals, the beamformer effectively realizes a direction sensitivity pattern, which has a lobe of high sensitivity in the direction of the desired sound source. E.g. for filters which are pure delays, the beamformer realizes a sin(x)/x pattern with a main lobe and side lobes. The problem with such a sensitivity pattern however is that also sound from other sources may be picked up. E.g. a noise source may be situated in the direction of one of the side lobes. To resolve this problem, the sidelobe canceller also comprises an adaptive noise cancellation stage. From the microphone measurements, noise reference signals are calculated, by blocking the desired sound component from them, i.e. in the example the noise in the sidelobes is determined. By means of an adaptive filter it is estimated from these noise measurements how much of the noise sources leaks in the lobe pattern, directed towards the desired sound. Finally, this noise is subtracted from what is picked up in the main lobe, leaving as a final audio signal largely only desired sound. If a directivity pattern is calculated corresponding to this optimized sidelobe canceller, it contains a main lobe towards the desired sound source, and zeroes in the directions of the noise sources.

There are a number of problems with the prior art sidelobe cancellers and beamformers, leading to the fact that in practice they often do not work like they ideally should. In particular, good sidelobe cancellers or beamformers are especially difficult to design for environments in which the direction of the desired sound source and/or the noise sources are changing, hence for which the filters may have to re-adapt during relatively short time intervals. However this situation is quite common, e.g. in a teleconference system which attempts to track a speaker moving through a room, or in a system with a person speaking to a sidelobe canceller incorporated in a mobile phone, and together with the mobile phone moving through a variable environment, such as e.g. encountered with a handsfree car phone kit.

Non pre-published European application 03104334.2 describes a beamformer/sidelobe canceller filter optimization technique to tackle two kinds of problem. The first is the presence of a significant amount of uncorrelated noise (theoretically corresponding to an infinity of sources) as e.g. the wind in an in-car application. The second problem tackled in this application is the prevention of introducing considerable "speech leakage" into the measures of the noise, which occurs if e.g. the beamformer main lobe is moving from its optimal direction towards a direction in between the desired sound source and an interfering sound source. An interfering sound source is below also called correlated noise, since it introduces related signal components in each microphone (e.g. purely delayed versions of each other).

The beamformer/sidelobe canceller of 03104334.2, on its own designed to deal with uncorrelated noise and speech leakage, is not capable of behaving correctly in the presence of correlated noise, i.e. a disturbance sound source, such as a fan or a motorcycle passing by.

Since there is not necessarily a physical difference between sound from a desired sound source, e.g. a near-end speaker, and disturbing sound form the correlated noise source, instead of locking on to the speaker or even remaining locked on the speaker, the system may diverge towards the noise source, e.g. if the noise source has a larger amplitude than the desired sound source during a time interval, which occurs e.g. when the near end speaker speaks rather silently and a loud truck passes by. Especially a sidelobe canceller which adapts its filters with cleaned signals obtained after a number of processing steps, although being capable of arriving at a good estimate of the optimum filters, is easily kicked out of its optimum, after which it is difficult to get the system back in its optimum, particularly in the presence of large amplitude correlated noise.

It is a first object of the invention to provide an adaptive beamformer unit which is relatively robust against the influences of correlated noise, i.e. an undesirable second sound source.

This first object is realized in that the adaptive beamformer unit according to the present invention comprises:

- a filtered sum beamformer arranged to process input audio signals from an array of respective microphones, and arranged to yield as an output a first audio signal predominantly corresponding to sound from a desired audio source by filtering with a first adaptive filter a first one of the input audio signals and with a second adaptive filter a second one of the input audio signals, the coefficients of the first filter and the second filter being adaptable with a first step size and a second step size respectively;
- noise measure derivation means arranged to derive from the input audio signals a first noise measure and a second noise measure; and
- an updating unit arranged to determine the first and second step size with an equation comprising in a denominator the first noise measure for the first step size, respectively the second noise measure for the second step size.

The beamformer and noise measures are known from 03104334.2, but a new updating strategy is used by the present beamformer, for increased robustness against correlated noise from disturbing sound sources.

The noise derivation means preferably applies some adaptive filtering on the microphone signals, e.g. a blocking matrix may be used to cancel an estimate of the desired audio (e.g.

speech) as picked up in a particular filter path i.e. by a particular microphone, from the total picked-up signal, yielding a good measure of the noise.

By supplying the updating unit part for each filter with its own noise measure, and deriving an instantaneous update step inversely proportional with the amount of noise, the filter can be made largely insensitive to the noise. If there is predominantly desired audio, the step size is best set relatively large, so that the filters can follow a moving desired source. If there is a considerable amount of noise, the denominator becomes large, yielding a small update step, hence the filter is effectively frozen, hardly responding to the deleterious influence of the noise. In particular if the filters are optimized for the desired source, room characteristics, microphone positions etc., with a small update step they will largely remain in the optimized settings.

In a preferred embodiment of the adaptive beamformer unit, the noise measure derivation means is arranged to derive the first noise measure from the first input audio signal by subtracting a desired sound measure of the sound from the desired audio source as picked up by the first microphone, and to derive the second noise measure from the second input audio signal by subtracting a second desired sound measure of the sound from the desired audio source as picked up by the second microphone.

Ideally the noise actually picked up by a microphone corresponding to a particular beamformer filter is used in the adaptation step equation. If there are e.g. two noise sources—a fan and a motor cycle—each of the microphones will pick up a total noise signal, being a combination of the sounds from the two sources, whereby the microphone signals are correlated so that the correlation of the subsignal introduced by each of the noise sources can be determined. Since a filter update equation typically contains an in-product of a measure of the desired audio and a measure of the total noise disturbance, this latter is the one which may move the filters away from their optimal setting, particularly if it is large. Ideally exactly this total noise should be countered.

A particular realization of this adaptive beamformer unit embodiment uses an equation to obtain the step sizes which equals:

$$\alpha_m[f,t]=\beta P_{zz}[f,t]/(P_{zz}[f,t]+\gamma P_{x_m x_m}[f,t]),$$

in which m is an index indicating which of the filters (f1(-t), f2(-t)) is adapted with the resulting step size $\alpha_m$, f denotes a frequency, t a time instant, z the first audio signal, $x_m$ is the first respectively the second noise measure, i.e. in this embodiment a measure of noise picked up by the corresponding m-th microphone, the desired audio being subtracted from the microphone input audio signal $u_m$ to obtain the noise measure, P . . . denotes an equation to obtain the power of a signal (. as indicated in its subscript), and β and γ are predetermined constants. The skilled person realizes that alternative power measures may be used, the typical one being e.g. the integral over a time interval of the signal squared.

However, in another embodiment the first noise measure and the second noise measure are determined from respective linear combinations of the input audio signals.

The deleterious behavior of the correlated noise may e.g. be countered by making the denominator of the step size equation dependent on the sum of all noise sources. Or linear combinations of the desired audio (typically speech)-cancelled microphone signals may be obtained from an adaptive noise estimator, which has as outputs measures of each noise source individually (a measure for the noise of the fan, another for the noise of the motorcycle, etc.). These noise measures may then be used in the denominator or added to a noise measure already present in the denominator of the update step equation. In many cases this gives somewhat less robust updating behavior than when measures for the total noise in a particular filter channel are used as described above.

The adaptive beamformer may also be comprised in a sidelobe canceller topology, which further comprises:

- an adaptive noise estimator, arranged to derive an estimated noise signal by filtering the first and the second noise measures derived from the input audio signals with a second set of adaptable filters;
- a subtracter to subtract the estimated noise signal from the first audio signal to obtain a noise cleaned second audio signal; and
- an alternative updating unit arranged to determine the first and second step size, with an equation comprising an amplitude measure of the second audio signal and in a denominator the first noise measure for the first step size respectively the second noise measure for the second step size.

A sidelobe canceller allows the derivation of a cleaner desired audio signal—the second audio signal—and also cleaner measures for the noise (i.e. signals which largely correspond to the actual picked up noise only, with as little as possible residue from the desired audio still left in it). Even better optimization results with this topology than with the above beamformer unit, but the sidelobe canceller, typically having not only the beamformer filters optimized, but the filters of the speech blocking matrix and noise estimator as well, is even more sensitive to noise, rendering the present novel updating scheme important. The skilled person can learn how to optimize the blocking matrix and noise estimator filters which are related to the filters of the beamformer from non-prepublished European application number 03104334.2.

An exemplary embodiment of the sidelobe canceller realizes the updating on the basis of the second audio signal by using an equation to obtain a step size which equals:

$$\alpha_m[f,t]=\beta P_{rr}[f,t]/(P_{rr}[f,t]+\gamma P_{v_m v_m}[f,t]),$$

in which m is an index indicating which of the filters (f1(-t), f2(-t)) is adapted with the resulting step size $\alpha_m$, f denotes a frequency, t a time instant, r the second audio signal, $v_m$ is a measure of noise picked up by the corresponding m-th microphone, the noise cleaned second audio signal (r) as measure of the desired audio being subtracted, P denotes an equation to obtain the power of a signal, and β and γ are predetermined constants.

This is again an optimal equation which uses the noise measurements $v_m$ (the noise measures corresponding one-to-one for this sidelobe canceller updating topology to the measures $x_m$ of the beamformer unit updating) for each separate filtering channel.

Embodiments of the adaptive beamformer or the sidelobe canceller comprise a scaling factor determining unit arranged to determine a single scale factor for scaling the step size of both the first filter and the second filter of the beamformer, the scale factor being determined on the basis of an amount of speech leakage and/or uncorrelated noise.

It is advantageous to combine the current correlated noise robust updating scheme, with schemes which are robust to other kinds of non-idealities, e.g. the scheme disclosed in 03104334.2. If the beamfomer/sidelobe canceller is near optimal the present adaptation step size determination scheme determines the correct step size. However if the filters are somewhat removed from optimum (or at least tends to diverge from optimum), the present scheme does not work well, but the step size determination of 03104334.2 may be used to get the filters back to their optimal settings.

It is also advantageous to arrange the adaptive beamformer or sidelobe canceller to receive position data from an audio-based speaker tracker arranged to determine a position in space of a speaker based on his speech and/or a video-based speaker tracker arranged to determine a position in space of a speaker based on a captured image, in which the first filter and the second filter coefficients are determined on the basis of the position determined by the audio-based speaker tracker and/or video-based speaker tracker.

If there are many powerful sound sources, it may be difficult even when combining the two above updating schemes to have the filters converge towards their optimum. The system may be helped by other means, e.g. the video-based speaker tracker may employ image processing software to detect a face corresponding to a speaker in a captured image, upon which the filter coefficients are re-initialized so that the main lobe directs at least a little more towards the position in space of the speaker's face.

The adaptive beamformer and sidelobe canceller may typically be applied in all kinds of (e.g. typically handsfree) speech communication systems, e.g. containing a pod for teleconferencing to be placed on a table, or a car kit (the microphones being distributed in the car). The beamformer unit or sidelobe canceller may also be comprised in a portable speech communication device, e.g. a mobile phone, personal digital assistant, dictation apparatus or other device with similar communication capabilities. The adaptive beamformer/sidelobe canceller is also advantageous in a voice-controlled apparatus, such as e.g. a remote control for a television, or a speech to text system on p.c., to improve the speech identification capabilities of the apparatus, noise being an important problem for those devices. Other devices may be all kinds of consumer devices, elevators or parts of intelligent houses, security systems, e.g. systems relying on voice recognition, consumer interaction terminals, etc.

The system may also be used in a tracking device, typically used in security applications, or applications which monitor user behavior for some reason. An example may be a camera that zooms in on a burglar based on his characteristic noise.

A corresponding method of adaptive beamforming, comprising:

a) filtering a first input audio signal from a first microphone with a first adaptive filter (f1(-t)) and a second input audio signal from a second microphone with a second adaptive filter (f2(-t)), and summing the filtered input audio signals to yield a first audio signal predominantly corresponding to sound from a desired audio source;

b) deriving a first noise measure and a second noise measure from the input audio signals;

c) adapting the coefficients of the first filter (f1(-t)) and the second filter (f2(-t)) with a first step size ($\alpha$1) respectively a second step size ($\alpha$2), which step sizes result from an equation comprising in a denominator the first noise measure (x1) for the first step size ($\alpha$1) respectively the second noise measure (x2) for the second step size is also disclosed.

These and other aspects of the beamformer and sidelobe canceller according to the invention will be apparent from and elucidated with reference to the implementations and embodiments described hereinafter, and with reference to the accompanying drawings, which serve merely as non-limiting specific illustrations exemplifying the more general concept.

Figure 2:
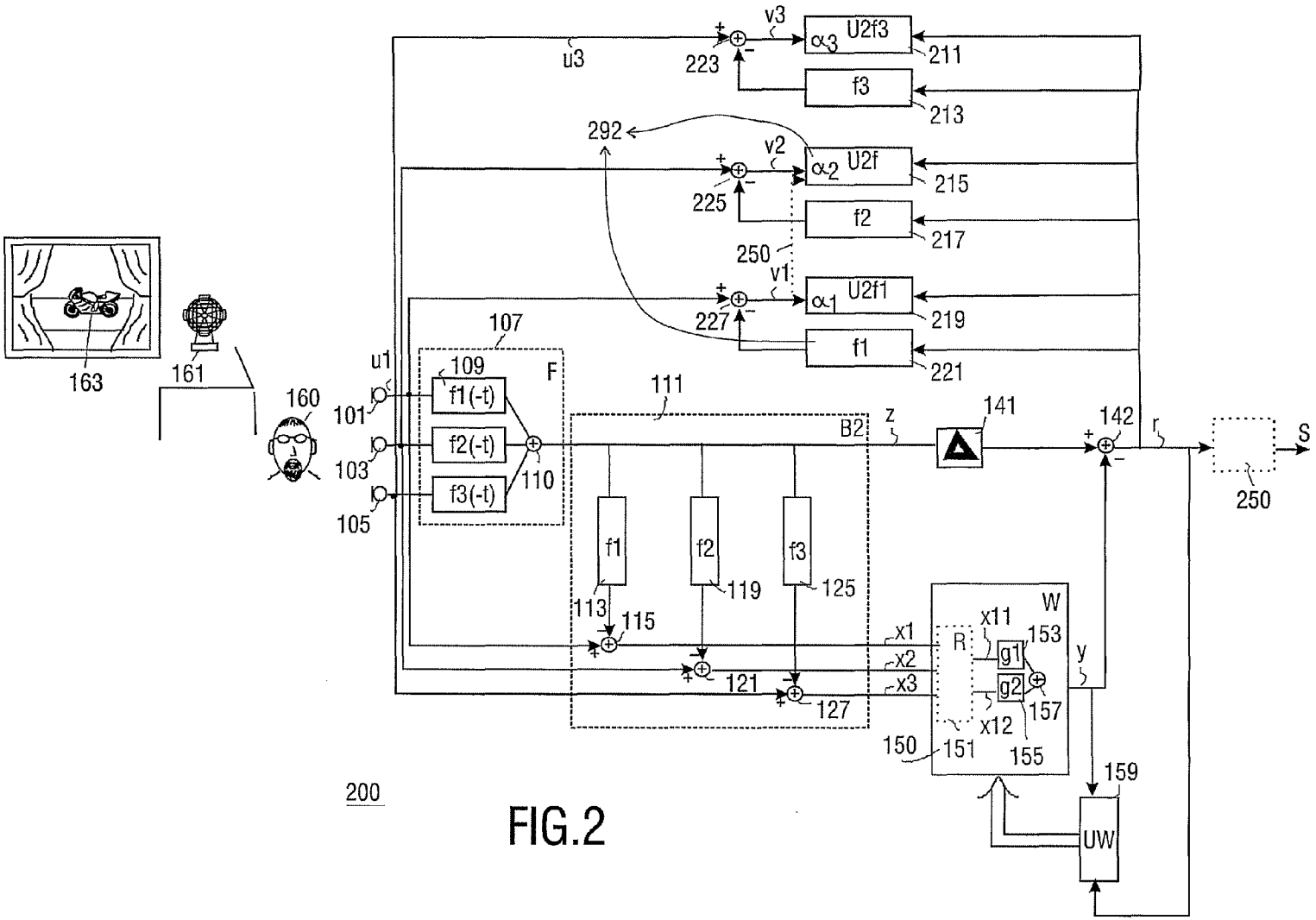
Figure 3:
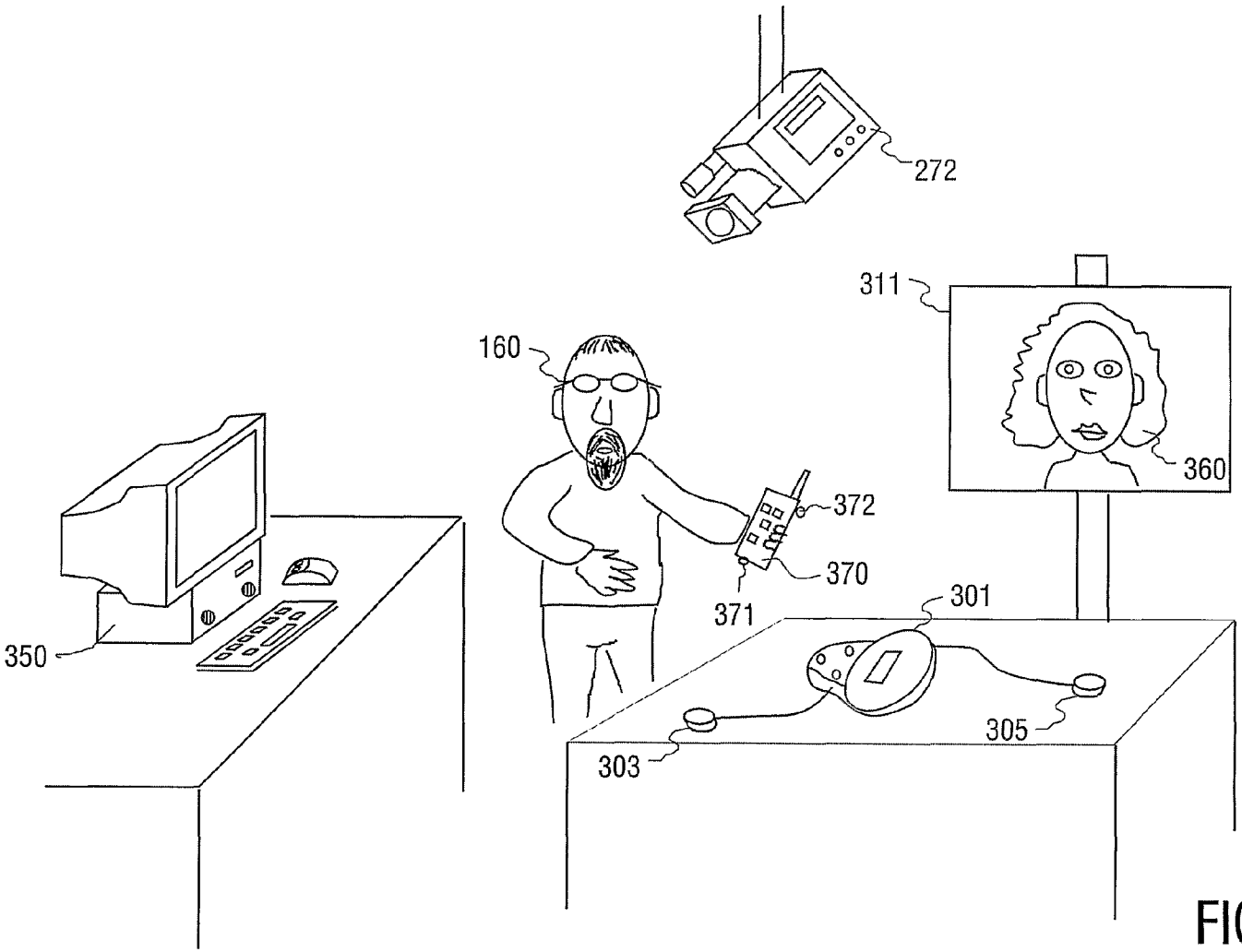

In the drawings:

FIG. 1 schematically shows an embodiment of the sidelobe canceller corresponding to a ratio equation based on the first audio signal;

FIG. 2 schematically shows an embodiment of the sidelobe canceller corresponding to a ratio equation based on the second audio signal;

FIG. 3 schematically shows a video conference application.

In FIG. 1, sound from a desired sound source 160, and possibly also form one or more undesirable noise sources 161 (noise should not be construed to be only a stochastic signal such as e.g. electronic thermal noise, but any non-desired/interfering audio signal), travels to an array of at least two microphones 101, 103. The signals u1, u2 output by these microphones are filtered by a first set of respective filters f1(-t), f2(-t) of a beamformer 107, the coefficients of which—typically a coefficient per band of frequencies—are adaptable to changing conditions in a room, e.g. of a moving desired sound source 160. The resulting signals outputted by the respective filters are summed by an adder 110, yielding a first audio signal z. Ideally the filters represent the inverse paths of the desired sound towards a particular microphone, hence by filtering a first microphone signal u1 by the first filter f1(-t) ideally exactly the desired sound is obtained. Hence, if the filters are well adapted, the first audio signal z is a good approximation to the desired sound. However, since the microphones also pick up noise, inevitably the first audio signal z also contains noise. The microphone signals u1, u2 are also used to produce noise measures x1, x2. To obtain signals only representative of the noise (mathematically speaking orthogonal to the desired audio signal), the desired signal is subtracted from the microphone signals u1, u2 by respective subtracters 115, 121. A so-called blocking matrix 111 thereto reapplies the sound traveling path filters f1, f2 on the first audio signal z, to obtain an estimate of the desired sound as picked up by the microphones. Hence the filters of the beamformer 107 and the blocking matrix are substantially the same apart from a time reversal. An adaptive noise estimator 150 estimates on the basis of the noise measurements x1, x2, . . . , as obtained from each of the microphones, how much noise is picked up in a main lobe of the beamformer directed towards the desired source or another part of the lobe pattern directed towards the desired sound, such as a sidelobe of that pattern, hence what the contribution is of the noise in the first audio signal z. The noise estimator 150 thereto has to apply a second set of adaptable filters g1, which are again related to the beamformer filters f1(-t), f2(-t). Because of mathematical dependency of one of the noise measurements x1, x2 (there are only two microphone measurements leading to a desired audio signal being the first audio signal z and two noise measurements x1, x2) before applying the second filters g1, a dimension reduction may be applied, as disclosed in 03104334.2.

Finally a subtracter 142 is comprised for subtracting the estimated noise signal y from the first audio signal z, the subtracter 142 and noise estimator 150 together constituting a noise canceller, yielding a second audio signal r, being relatively free of noise. Preferably a delay element 141 is present to present the correct temporal samples (or analog equivalent) corresponding to those of the noise signal y.

The above described system is a sidelobe canceller as known from prior art.

The beamformer filters (and preferably all related filters, i.e. the blocking matrix filters and noise estimation filters) are updated towards their instantaneous optimum by update units 117, 123.

A typical update rule for a prior art beamformer takes the first audio signal z and a respective noise measurements as input and evaluate a new filter coefficient for a particular frequency range or band around frequency f:

$$F(f,t+1)=F(f,t)+\frac{\alpha}{P_{zz}[f,t]}z^*[f,t]x[f,t] \quad \text{[Eq. 1]}$$

In this equation F is the particular filter coefficient for a particular frequency range at discrete time t resp. t+1, $\alpha$ is a constant, $P_{zz}[f,t]$ is a measure of the power of the first audio signal, x is the respective noise measure (e.g. x1 corresponding to the first filter f1(-t), is a measure of the noise picked up by the first microphone 101, and further treated in the first beamformer channel, and is typically obtained by subtracting an estimate of the desired audio signal—which is also picked up by the first microphone—from the first input audio signal actually picked up by the first microphone 101), and the star denotes complex conjugation. Hence if the noise is approximately orthogonal to the desired first audio signal z, as it should be if the sidelobe canceller is optimized, the filter coefficient is hardly updated, and the same applies if there is temporarily no noise. The resulting new coefficients obtained by the updating units are copied to the respective filters, e.g. the beamformer filters f1(-t), f2(-t).

A typical update rule in a prior art noise canceller update unit 159 for updating the second set of filters g1, . . . is:

$$G(f,t+1)=G(f,t)+\frac{\alpha}{P_{yy}[f,t]}r^*[f,t]y[f,t], \quad \text{[Eq. 2]}$$

in which r is the second audio signal, and $P_{yy}[f,t]$ is a measure of the power of the noise signal y.

According to the invention, instead of using a fixed step size $\alpha$ for each update equation of the beamformer filters [Eq. 1] an optimal step size is determined depending upon the amount of correlated noise picked up in the particular channel.

It can be derived theoretically that when the filter is optimized a performance measure may be given for a particular m-th filter of the beamformer being:

$$Q_m[f,t]\approx\frac{2}{\alpha}\frac{P_{zz}[f,t]}{\gamma P_{x_m x_m}[f,t]} \quad \text{[Eq. 3]}$$

in which $\alpha$ is the update step size and $\gamma$ a constant which is e.g. approximately equal to the number of microphones. A decrease of the step size leads to an increase of the performance, on the other hand the performance decreases if the power of the picked up noise increases.

Furthermore, update equation 1 may be conceptually/approximately construed as consisting of the following contributions:

$$F(f,t+1)\therefore F(f,t)+\frac{\alpha}{P_{zz}[f,t]}(\lambda s+n_c)^*(\mu s+\nu n_c) \quad \text{[Eq. 4]}$$

One may assume that under optimized conditions, the first picked up correlated noise term $n_c$ is negligible compared to the desired audio $\lambda s$ ($\lambda$ is a proportionality constant because the desired audio measure z is not exact, but rather still contains other factors). $\mu$ is another constant representing the speech leakage in the noise measures. It will be assumed that under optimal conditions speech leakage is also negligible, since the blocking matrix filters are optimal. Hence by doing the approximation analysis one sees that the filters have a tendency to diverge linearly with the amount of correlated noise.

The proposed solution is to divide the step size $\alpha$ by an amplitude measure of the correlated noise, in particular a power measure. In this latter case the second power wins over the linear correlated noise term in the numerator, i.e. the update becomes less sensitive the larger the amplitude of the noise. However, the exact correlated noise is not known, hence a measure or correlate of it needs to be used. The noise measures $x_i$ before the noise estimator 150, obtained by subtracting a measure of the desired audio, such as e.g. the first audio signal z from each of the respective input audio signals $u_i$, are a good measure. Preferably the robust update steps are determined as:

$$\alpha_m[f,t]=\beta P_{zz}[f,t]/(P_{zz}[f,t]+\gamma P_{x_m x_m}[f,t]) \quad \text{[Eq. 5]},$$

in which m is an index indicating which of the filters (f1(-t), f2(-t)) is adapted with the resulting step size $\alpha_m$, f denotes a frequency, t a time instant, z the first audio signal, $x_m$ is a measure of noise picked up by the corresponding m-th microphone, the desired audio being subtracted from the microphone input audio signal $u_m$, P denotes an equation to obtain the power of a signal, and $\beta$ and $\gamma$ are predetermined constants.

The beamformer with above described updating rule works well when the filters are near optimal, even in the presence of strong interfering noise sources. However the system may be improved by adding components aiding the convergence towards the optimum. Therefore the beamformer may cooperate with a video-based speaker tracker 274, which is arranged to determine the position of the desired sound source from images captured by a camera 272. In the case where the desired audio is speech, face detection as known from the prior art of image processing (e.g. skin-tone detection, eye detection, face geometry verification, etc,) may be employed to identify one or more speakers. Lip tracking (e.g. with snakes—a mathematical curve tracking technique) may also be used to check if the person is actually speaking, or if speech from e.g. a radio is detected.

From the image processing a rough or more precise position estimate is obtained, which is transmitted to the beamformer. The beamformer re-determines its coefficients based on the position estimate. E.g. it may comprise a look-up table for more optimal starting coefficients for a number of positions. A priori knowledge about the room may be used. A rough positioning algorithm determines simply on which side of the middle of the image the speaker is, and then re-initializes the beamformer main lobe towards the right respectively left side. More complex image analysis may be used to determine the position of the speaker more accurately, e.g. in 3D when two camera's are used. By mapping a face model the direction of the speakers head may also be determined (simple algorithms exist based on the geometry of key points such as eyes). Finally if knowledge about the room is present, the filters may be re-determined with rather accurate coefficients of the head related transfer functions for that particular room.

Additionally or alternatively an audio-based speaker tracker 270 may be connected to or comprised in the apparatus comprising the beamformer according to the present invention. This tracker 270 may e.g. use correlation analysis of the picked up input audio signals (u1, u2, . . . ) to determine direction candidates corresponding to audio sources present in the surrounding, as in WO 00/28740. An advanced version may further determine who the speaker is based on speech analysis (e.g. the formants of a woman's voice have different frequencies than those of a man's voice), and reposition the main lobe to the direction corresponding with the particular speaker as identified.

Typically this direction fixing is only done "initially" and then the beamformer/sidelobe canceller is left to fine-tune on its own with the above adaptation algorithms. If the fine-tuned direction however moves outside a predetermined accuracy solid angle, the present trackers will re-initialize the filters.

Both estimates may be combined with a predetermined combination algorithm.

FIG. 2 shows a sidelobe canceller 200 topology for which is arranged to perform the updating of the beamforming/blocking filters (in this example three filters f1(-t), f2(-t), f3(-t), f1, f2, f3) as a function of a second audio signal r. Therefore, second beamformer update units 219, 215, 211 are schematically shown above the prior art side canceller part as described before. The second beamformer update units 219, 215, 211 have as second input a similarly constructed set of second noise measures v1, v2, v3, which are constructed with respective subtracters, e.g. subtracter 227 subtracting a filtered version of the second audio signal r with a first blocking filter fl from the first microphone signal u1, and so on.

It can be proven mathematically that similar to eq. 1, a basic update formula may be intelligently chosen as:

$$F(f, t+1) = F(f, t) + \frac{\alpha}{P_{rr}[f, t]} r^*[f, t] v[f, t], \qquad \text{[Eq. 6]}$$

in which r is the second audio signal, v is one of the second noise measurements v1, v2, v3 corresponding to the particular beamformer filter to be updated and $P_{rr}[f]$ is a measure of the power of the second audio signal r.

A correlated noise-robust update step equation may be derived analogous to Eq. 5 for this second updating topology:

$$\alpha_m[f,t]=\beta P_{rr}[f,t]/(P_{rr}[f,t]+\gamma P_{v_m v_m}[f,t]) \qquad \text{[Eq. 7]}$$

In this case the second audio signal r is used (which is even more noise cleaned, i.e. an even better estimate of the true speech), as well as corresponding noise measures $v_m$ in the denominator of the step size equation according to the present invention. Why this works can be seen by dropping for this topology the $n_c$ term in the first term between ellipses (leaving only the λs) the approximation equation 4.

The sidelobe canceller may also cooperate with a scaling factor determining unit 250, e.g. the one disclosed in 03104334.2 (although not shown, similarly also the beamformer's filters on their own can be tuned by such a scaling factor determining unit 250 as can be learned from 03104334.2). This scaling factor determining unit 250 derives a single scale factor for all the filters of the beamformer (and if applicable the blocking matrix and noise estimator). Since in the presence of a lot of uncorrelated noise or speech leakage the beamformer or sidelobe canceller has difficulties in converging, the step size is set small for these occurrences, even when all filters are near optimum. These two updating strategies together make an even more robust system.

In FIG. 3 a video conference application is shown, e.g. for home or professional use. A handsfree speech communication device 301 is in this case a pod, with telephone capabilities, and e.g. two microphones 303, 305 for pick-up (e.g. four microphones may be configured in a cross topology for four speakers around a table). Near end speaker 106 communicates with far-end speaker 360. Ideally speaker 160 would like to have the freedom to walk around with the beamformer/sidelobe canceller keeping locked on to him, even in the presence of noise sources. He can also use the beamformer/sidelobe canceller in a voice control unit, e.g. to control the behavior of a consumer apparatus 350, such as a PC, TV, home appliance such as the central heating, etc., which apparatus then typically contains a plurality of microphones and the present invention. Cheaper devices may get their commands from a home central computer containing the voice control unit.

The user 160 also has a portable speech communication device 370 with microphones 371 and 372 incorporating the beamformer unit or the sidelobe canceller. In the future conferencing systems may move away from the integrated system solutions towards a wireless system where each participant has his personal mobile device, e.g. attacked to his clothing or hanging around his neck.

The algorithmic components disclosed may in practice be (entirely or in part) realized as hardware (e.g. parts of an application specific IC) or as software running on a special digital signal processor, a generic processor, etc.

Under computer program product should be understood any physical realization of a collection of commands enabling a processor —generic or special purpose—, after a series of loading steps to get the commands into the processor, to execute any of the characteristic functions of an invention. In particular, the computer program product may be realized as computer program code on a non-transitory computer-readable medium, such as, e.g., a disk or tape, or computer program code stored in a memory. Alternatively, the program code may be transmitted over a network connection —wired or wireless—, or presented on paper. Apart from program code, characteristic data required for the program may also be embodied as a computer program product.

It should be noted that the above-mentioned embodiments illustrate rather than limit the invention. Apart from combinations of elements of the invention as combined in the claims, other combinations of the elements are possible. Any combination of elements can be realized in a single dedicated element.

Any reference sign between parentheses in the claim is not intended for limiting the claim. The word "comprising" does not exclude the presence of elements or aspects not listed in a claim. The word "a" or "an" preceding an element does not exclude the presence of a plurality of such elements.

The invention claimed is:

1. An adaptive beamformer unit comprising:

a filtered sum beamformer for processing input audio signals (u1, u2) from an array of respective microphones, and for forming, as an output, a first audio signal (z) predominantly corresponding to sound from a desired audio source by filtering, with a first adaptive filter (f1(-t)), a first one of the input audio signals (u1) and by filtering, with a second adaptive filter (f2(-t)), a second one of the input audio signals (u2), the coefficients of the first filter (f1(-t)) and the second filter (f2(-t)) being adaptable with a first step size (α1) and a second step size (α2), respectively;

noise measure derivation means for deriving, from the input audio signals (u1, u2), a first noise measure (x1) and a second noise measure (x2); and an updating unit for determining the first and the second step size (α1, α2), respectively, with an equation comprising, in a denominator, the first noise measure (x1) for the first step size (α1) or the second noise measure (x2) for the second step size (α2), respectively.

2. The adaptive beamformer unit as claimed in claim 1, wherein the noise measure derivation means derives the first noise measure (x1) from the first input audio signal (u1) by subtracting a desired sound measure (m1) of the sound from the desired audio source as picked up by the first microphone, and derives the second noise measure (x2) from the second input audio signal (u2) by subtracting a second desired sound measure (m2) of the sound from the desired audio source as picked up by the second microphone.

3. The adaptive beamformer unit as claimed in claim 2, wherein the equation to obtain the first and second step size ($\alpha$1, $\alpha$2), respectively, equals:

$$\alpha_m[f,t]=\beta P_{zz}[f,t]/(P_{zz}[f,t]+\gamma P_{x_m x_m}[f,t]),$$

in which m is an index indicating which of the first or second adaptive filters (f1(-t), f2(-t), respectively) is adapted with the resulting step size $\alpha_m$, f denotes a frequency, t a time instant, z the first audio signal, $x_m$ is the first or the second noise measure, respectively, $P_{ss}$ denotes an equation to obtain a power of the signal identified in its subscript s, and $\beta$ and $\gamma$ are predetermined constants.

4. The adaptive beamformer unit as claimed in claim 1, wherein the first noise measure (x1) and the second noise measure (x2) are determined from respective linear combinations of the input audio signals (u1, u2).

5. The adaptive beamformer unit as claimed in claim 1, wherein said adaptive beamformer unit further comprises a scaling factor determining unit for determining a single scale factor (S) for scaling the step size ($\alpha$1, $\alpha$2, respectively) of both the first filter (f1(-t)) and the second filter (f2(-t)) of the beamformer, the scale factor (S) being determined on the basis of an amount of speech leakage and/or uncorrelated noise.

6. The adaptive beamformer unit as claimed in claim 1, wherein said adaptive beamformer unit receives position data from an audio-based speaker tracker for determining a position in space of a speaker based on the speaker's speech and/or a video-based speaker tracker for determining a position in space of a speaker based on a captured image, in which the first filter (f1(-t)) and the second filter (f2(-t)) coefficients are initially determined on the basis of the position determined by the audio-based speaker tracker and/or video-based speaker tracker.

7. A sidelobe canceller comprising:

a filtered sum beamformer for processing input audio signals (u1, u2) from an array of respective microphones, an for forming, as an output, first audio signal (z) predominantly corresponding to sound a desire audio source by filtering, with a first a filter (f1(-)), first one of the input audio signals (u1) and by filtering, with a second adaptive filter (f2(-t)), a second one of the input audio signals (u2), the coefficients of the first filter (f1(-t)) an the second filter (f2(-t)) being adaptable with a first step size ($\alpha$l) and a second step size ($\alpha$2), respectively;

an adaptive noise estimator for deriving an estimated noise signal (y) by filtering the first and the second noise measures (x1, x2) derived from the input audio signals (u1, u2) with a second set of adaptable filters (g1, g2);

a subtracter for subtracting, the estimated noise signal (y) from the first audio signal (z) to obtain a noise-cleaned second audio signal (r); and an updating unit for determining the first and second step size ($\alpha$1, $\alpha$2), respectively, with an equation comprising an amplitude measure of the second audio signal (r) and, in a denominator, the first noise measure (x1) for the first step size ($\alpha$1) or the second noise measure (x2) for the second step size ($\alpha$2), respectively.

8. The sidelobe canceller as claimed in claim 7, wherein the equation to obtain a step size equals:

$$\alpha_m=\beta P_{rr}[f,t]/(P_{rr}[f,t]+\gamma P_{v_m v_m}[f,t]),$$

in which m is an index indicating which of the first or second adaptive filters (f1(-t), f2(-t)) is adapted with the resulting step size $\alpha_m$, f denotes a frequency, t a time instant, r the second audio signal, $v_m$ is a measure of noise picked up by the corresponding m-th microphone, the noise-cleaned second audio signal (r) as measure of the sound from the desired audio source being subtracted from the respective input signal (u1, u2) to obtain the noise measure $v_m$, P denotes an equation to obtain the power of a signal, and $\beta$ and $\gamma$ are predetermined constants.

9. The sidelobe canceller as claimed in claim 7, wherein said sidelobe canceller further comprises a scaling factor determining unit for determining a single scale factor (S) for scaling the step size ($\alpha$1, $\alpha$2, respectively) of both the first filter (f1(-t)) and the second filter (f2(-t)) of the beamformer, the scale factor (S) being determined on the basis of an amount of speech leakage and/or uncorrelated noise.

10. A handsfree speech communication system comprising an adaptive beamformer unit as claimed in claim 1.

11. A portable speech communication device comprising at least two microphones to yield input audio signals (u1, u2), and further comprising an adaptive beamformer unit as claimed in claim 1 to process the input audio signals (u1, u2).

12. A voice control unit comprising an adaptive beamformer unit as claimed in claim 1, and further comprising speech analysis means for recognizing voice commands.

13. A consumer apparatus comprising a voice control unit as claimed in claim 12.

14. A method of adaptive beamforming, comprising the steps of:

a) filtering a first input audio signal (u1) from a first microphone (101) with a first adaptive filter (f1(-t)), filtering a second input audio signal (u2) from a second microphone (103) with a second adaptive filter (f2(-t)), and summing the filtered input audio signals to yield a first audio signal (z) predominantly corresponding to sound from a desired audio source;

b) deriving a first noise measure (x1) and a second noise measure (x2) from the input audio signals (u1, u2); and c) adapting the coefficients of the first filter (f1(-t)) and the second filter (f2(-t)) with a first step size ($\alpha$1) and a second step size ($\alpha$2), respectively, said step sizes result from an equation comprising, in a denominator, the first noise measure (x1) for the first step size ($\alpha$1) or the second noise measure (x2) for the second step size ($\alpha$2), respectively.

15. A non-transitory computer-readable medium having stored therein a computer program comprising code which, when loaded into a processor, causes the processor to perform the method as claimed in claim 14.

* * * * *